United States Patent [19]

Norris

[11] 4,249,492

[45] Feb. 10, 1981

[54] CONSTANT TORQUE ROTARY ENGINE

[76] Inventor: Gilbert H. Norris, R.F.D. No. 1, Cameron Rd., Mass.SCOT

[21] Appl. No.: 949,697

[22] Filed: Oct. 10, 1978

[51] Int. Cl.[3] ..... F02B 53/00

[52] U.S. Cl. ..... 123/234; 418/226

[58] Field of Search ..... 123/234, 236, 237, 241, 123/247, 248; 418/225, 226, 227, 270

[56] References Cited

U.S. PATENT DOCUMENTS

| | | | |
|---|---|---|---|
| 1,213,092 | 1/1917 | Gebhardt | 123/237 |
| 3,521,979 | 7/1970 | Horst | 418/34 |
| 3,867,075 | 2/1975 | Horst | 418/226 X |

*Primary Examiner*—Michael Koczo

*Attorney, Agent, or Firm*—Pitts and Kesterson

[57] ABSTRACT

An internal combustion engine is provided which includes a compression bank and an expansion bank each of which include a toroidal cylinder and at least a pair of cooperating pistons within each cylinder. The pistons define expanding and contracting chambers within the cylinders. The chambers defined by the revolving pistons in the compression bank serve to force a compressed mixture of fuel and air, or other oxidizing agent, into a combustion chamber where the fuel is ignited and acts against the expansion bank pistons forcing them in opposite directions. At least one piston in the expansion bank and the compression bank revolves within its respective cylinder in a predetermined and unitary direction. A single bank or plurality of compression banks of pistons can be used as a compressor. Moreover, a single or plurality of expansion banks of pistons can be used.

15 Claims, 37 Drawing Figures

CONSTANT TORQUE ROTARY ENGINE

This invention relates to an internal combustion engine and more particularly to an internal combustion engine having at least one toroidal shaped cylinder and at least one piston which revolves in a predetermined manner.

Conventional internal combustion engines such as used in motor vehicles include pistons which reciprocate responsive to the rapid burning of a mixture of compressed fuel, such as gasoline, and air. The pistons are drivingly connected to a drive shaft which serves as a power take-off for driving the desired machinery, such as the wheels of an automobile. Heretofore, the reciprocating movement of the pistons has been necessitated in order to accomplish the compression and expansion of the fuel. More specifically, during the compression stroke, the fuel and air mixture introduced into the cylinder is compressed into a small volume, normally between the leading surface of the piston and one of the closed ends of the cylinder, at the terminal end of the compression stroke. The fuel mixture is ignited either by the increased temperature produced by the compression of the fuel, as in the case of a diesel engine, or by exposing the fuel to a spark. Upon igniting the fuel, the fuel mixture expands and acts against the closed end of the cylinder, which is stationary and the head of the piston which being the only moveable part, is forced in the opposite direction, i.e. away from the closed end of the cylinder. This last mentioned movement of the piston is called the expansion stroke, and it is during this stroke of the piston that driving forces are applied to the drive shaft, normally through a crank shaft.

The efficiency with which conventional internal combustion engines operate is reduced by the reciprocating motion of the pistons. More specifically, the piston direction is reversed at the terminal end of the compression and expansion strokes. Thus, the energy generated by the velocity of the piston during its travel between the opposite ends of the stroke is reduced to nil at the ends of the strokes. This results in a substantial reduction of the operating efficiency of the engine. Various methods and apparatus have been developed to assist in overcoming the energy loss occasioned by reversing the direction of the piston. However, known rotary engines which continue their rotary motion in a unitary direction suffer certain disadvantages, particularly when the combustion chamber is defined such that the explosion of the fuel acts on opposite sides of a fulcrum thereby producing counter productive moments.

A further disadvantage of known internal combustion engines results from the discrete surges of power produced upon the ignition of the fuel in the expansion stroke. This results in rapid changes in the magnitude of the torque applied to the drive shaft and/or crankshaft which tends to produce vibrations and reduces the useful life of the engine components. These rapid changes in torque are inherent byproducts of engines in which the expansion and compression strokes are accomplished in the same cylinder since the cylinder can be used for only one such stroke at a time.

Accordingly it is an object of this invention to provide an improved internal combustion engine. Another object of the invention is to provide an internal combustion engine having a substantially constant torque. It is a further object of this invention to provide an internal combustion engine having pistons or at least one piston which does not reverse its direction of travel during operation of the engine. Yet another object of the invention is to provide an engine having at least one section or bank which is designed to serve as a compressor as necessary or desired. A still further object of the invention is to provide an engine having at least one bank which can serve as an expansion bank. A further object is to provide an engine with improved operational efficiency. The engine herein disclosed is also capable of utilizing steam to expand the cylinders during the expansion stroke. The steam can be used in conjunction with conventional internal combustion engine fuel as necessary or desired.

Other objects of the invention will become apparent upon reading the following detailed description together with the drawings, in which.

Figure 21B:
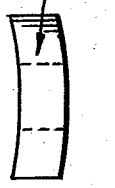
Figure 21A:
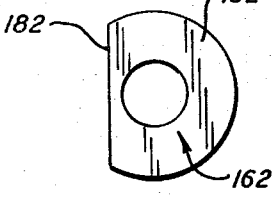

FIGS. 21*a–b* illustrates a cam member used to assist in controlling the rotation of certain of the pistons.

Figure 22:
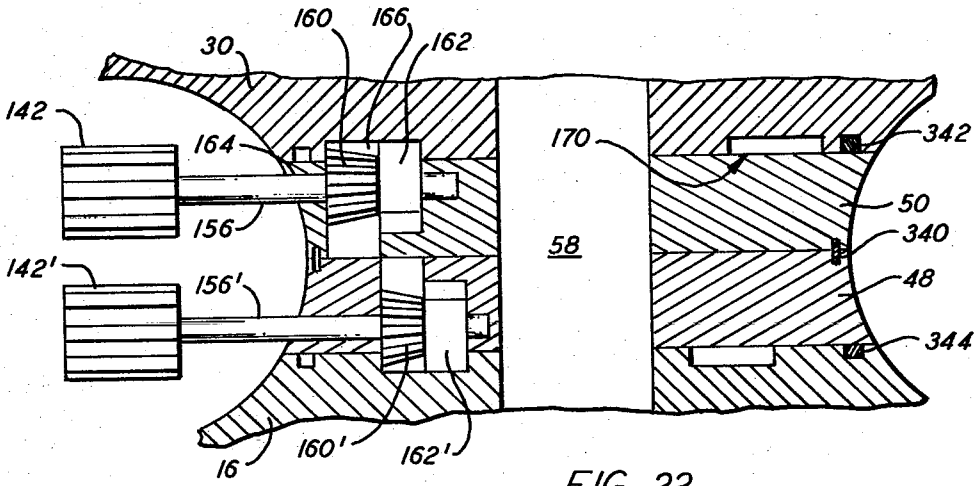

FIG. 22 is a sectional view depicting adjacent discs and associated pinions used in one embodimen to control the rotation of the piston heads with a portion of the engine broken away for clarity.

Figure 23:
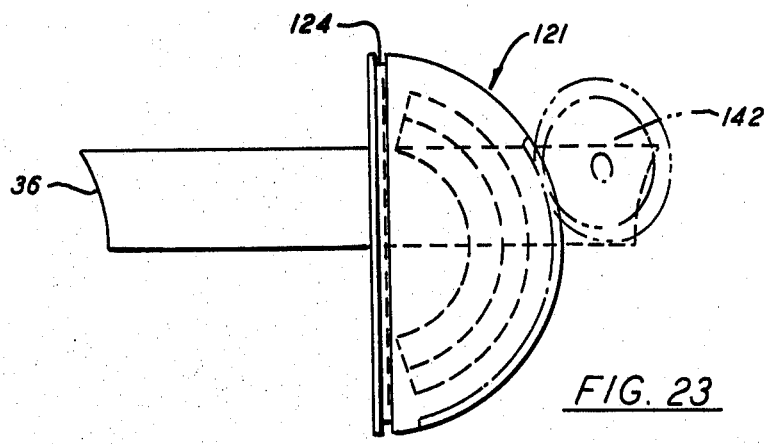

FIG. 23 is a diagrammatic plan view of one piston mounted on a disc, including a pinion gear which is used to rotate the piston.

Figure 24:
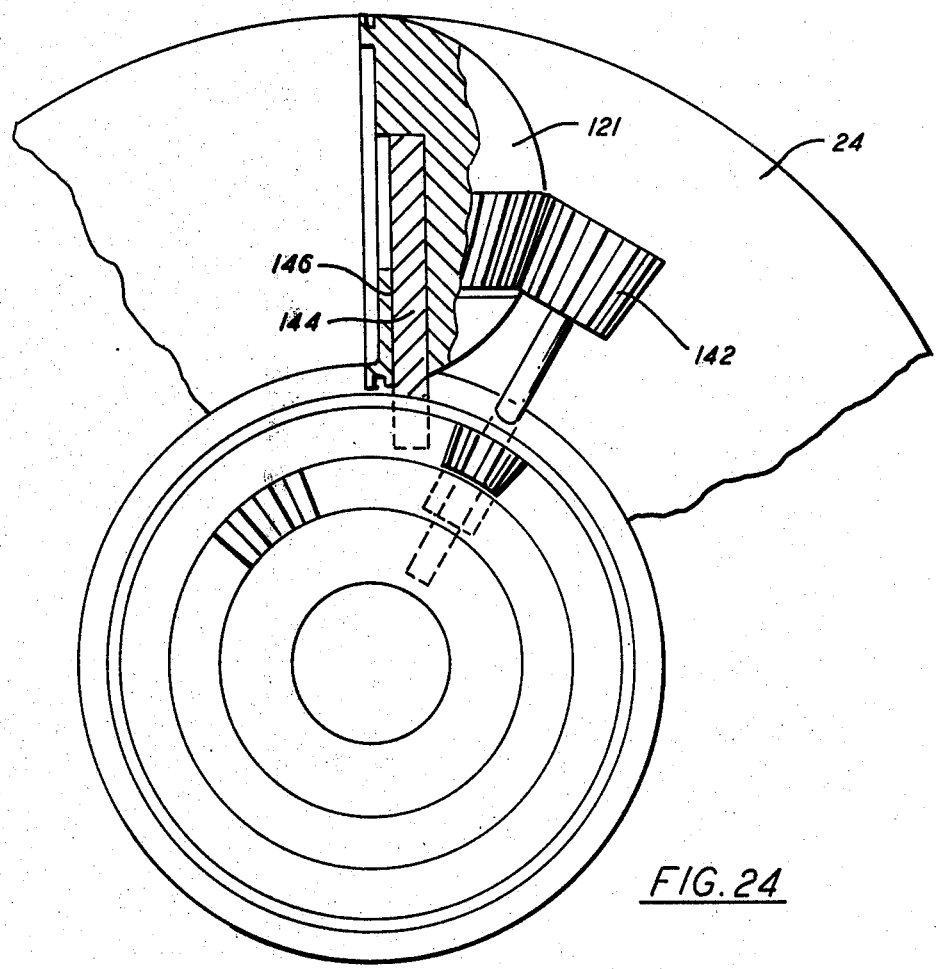

FIG. 24 is a side elevation view showing a piston mounted on a disc with portions of the engine broken away for illustrative purposes.

Figure 26:
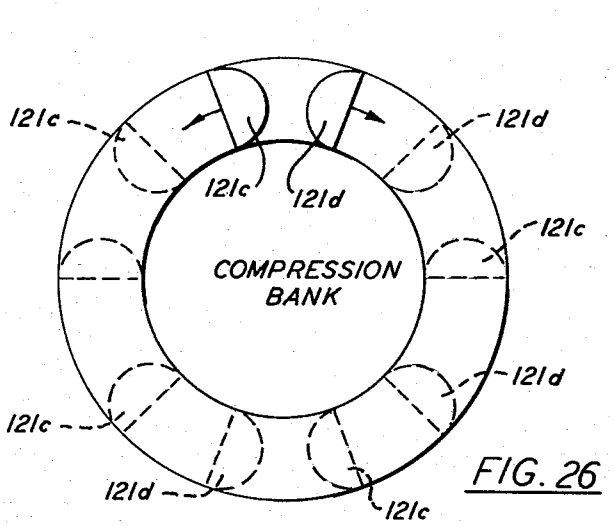
Figure 25:
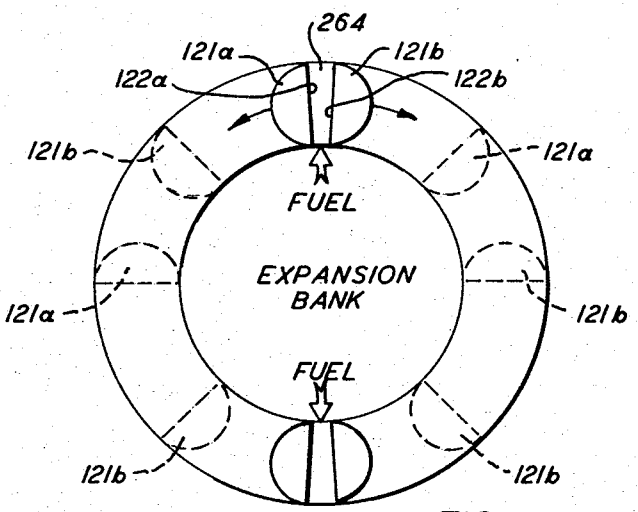

FIGS. 25–26 are diagrammatic views of various stages of operation of the expansion and compression cycles, respectively.

Figure 27:
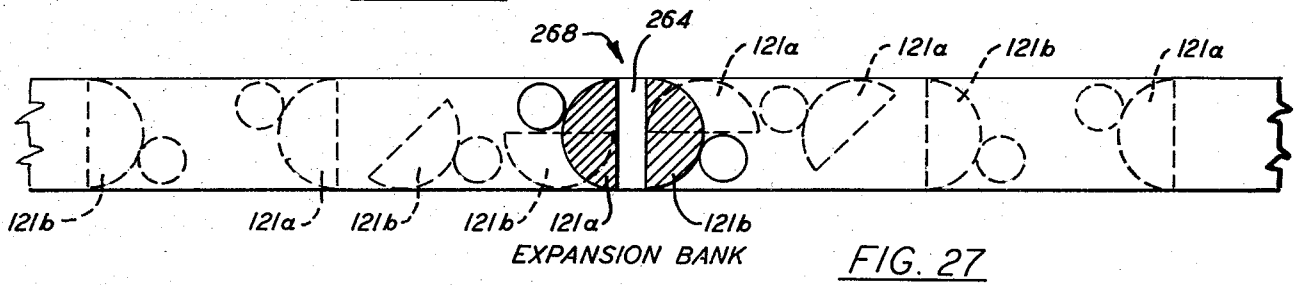
Figure 28:
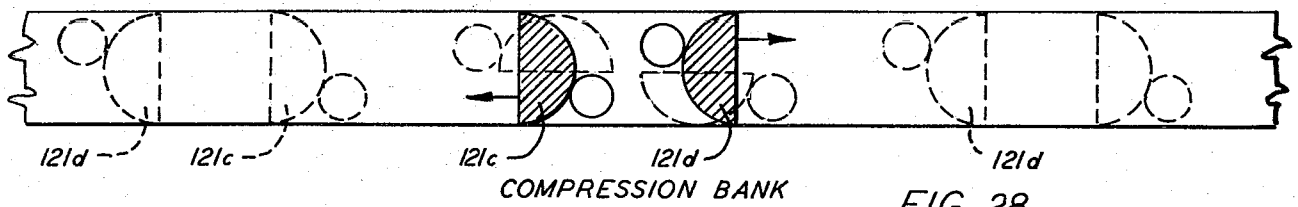

FIGS. 27–28 are stretched out views showing movements of pistons during portions of the cycle in the expansion and compression banks, respectively.

Figure 29:
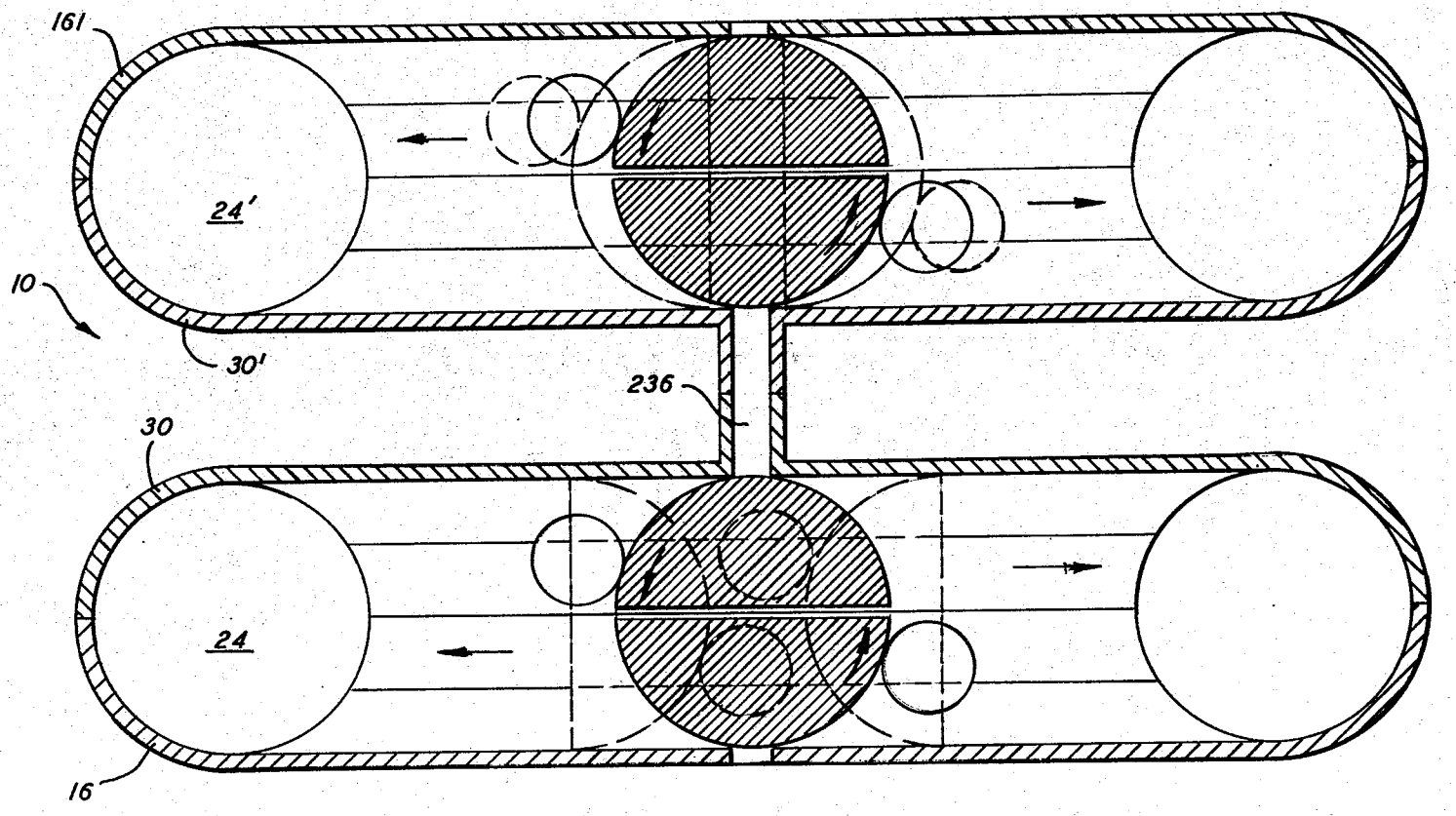

FIG. 29 is a diagrammatic illustration of the connected compression bank and expansion banks.

FIGS. 30–33 illustrate an alternate embodiment of the pistons and associated discs and cylinders.

Figure 34:
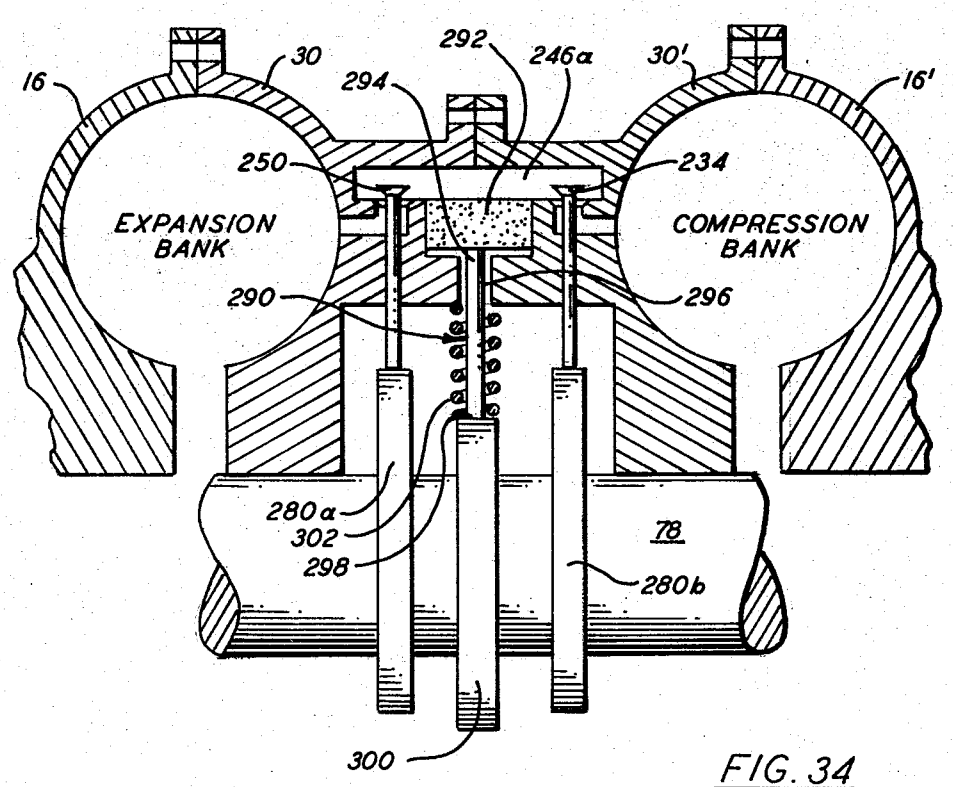

FIG. 34 is an alternate embodiment of a combustion chamber which is compressible to enhance the expulsion of expended gases therefrom.

Figure 36:
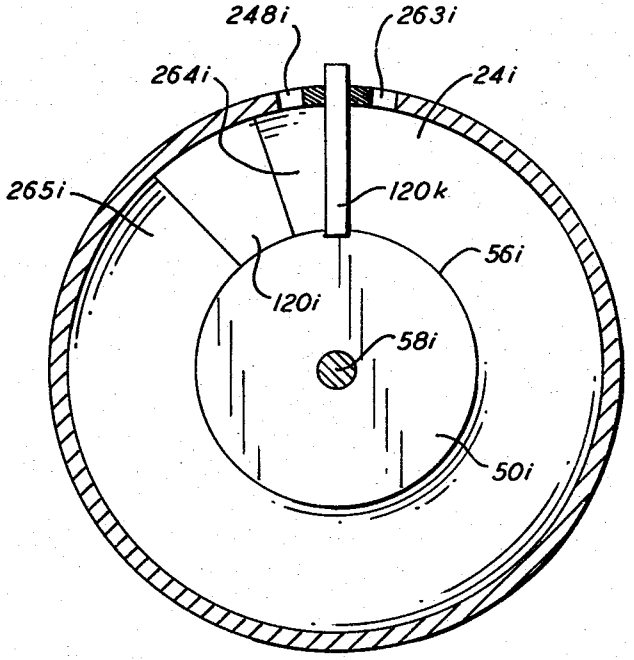
Figure 35:
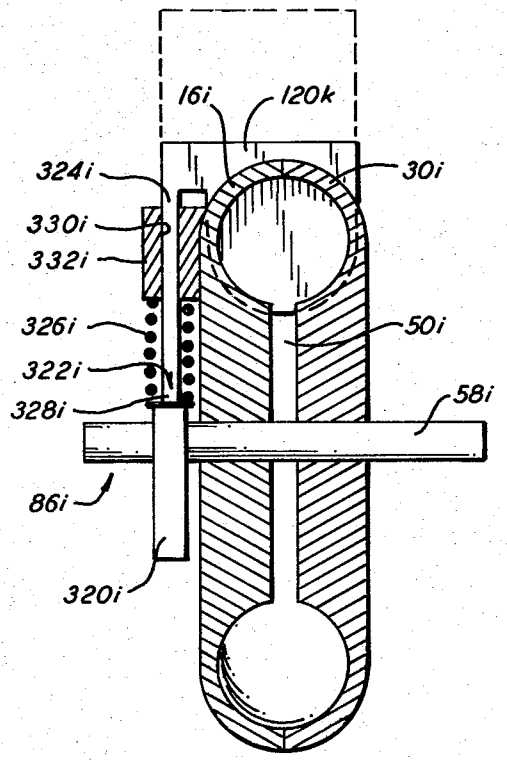

FIGS. 35 and 36 illustrate an alternate embodiment of the invention in which one of the cooperating pistons does not revolve.

Accordingly, an internal combustion engine having a substantially constant torque is provided which includes piston means which revolves past cooperating piston means. More specifically, the engine includes at least one toroidal cylinder, having at least one operatively associated disc which revolves with respect to said cylinder. A drive shaft mechanism carries at least one disc. Piston means cooperates to define an expanding chamber during revolution of the disc. The piston means includes at least one piston which is mounted on the disc and revolves in a predetermined direction within the cylinder. Means are provided for controlling the mode of operation of the piston means such that the pistons are selectively placed in the passing mode and the expansion mode at predetermined times during the revolution of at least one of the pistons. The pistons are positionable in the passing mode so that at least one of the pistons can revolve past its cooperating piston during revolution of the disc. The pistons are positionable in an expansion mode so that the opposite end portions of the chamber between cooperating pairs of pistons are defined by the cooperating pistons. An expanding mixture, such as fuel and air is introduced between the pistons at a predetermined time for producing the expansion or power stroke.

The present invention is readily adaptable for use as a device for compressing/expanding fluid. In this embodiment, a wall defines a toroidal cylinder which is operatively associated with at least one disc mounted for revolution with respect to the cylinder. A drive shaft mechanism carries the disc. Piston means cooperate to define a compressing/expanding chamber during revolution of the disc. The piston means includes at least one piston mounted on the disc which revolves in a predetermined direction within the cylinder. Means are provided for controlling the mode of operation of the pistons such that the pistons are selectively placed in a passing mode and a compression/expansion mode at predetermined times during the revolution of at least one of the pistons. The pistons are positionable in a passing mode so that at least one of the pistons can revolve past its cooperating piston during the disc revolution. The pistons are positionable in a compression-/expansion mode so that the opposite end portions of the chamber defined between the cooperating pairs of pistons are defined by the pistons. Each piston includes a piston head which is proportioned for sealing the cross-section of the cylinder upon being positioned in the compression/expansion mode.

Figure 1:
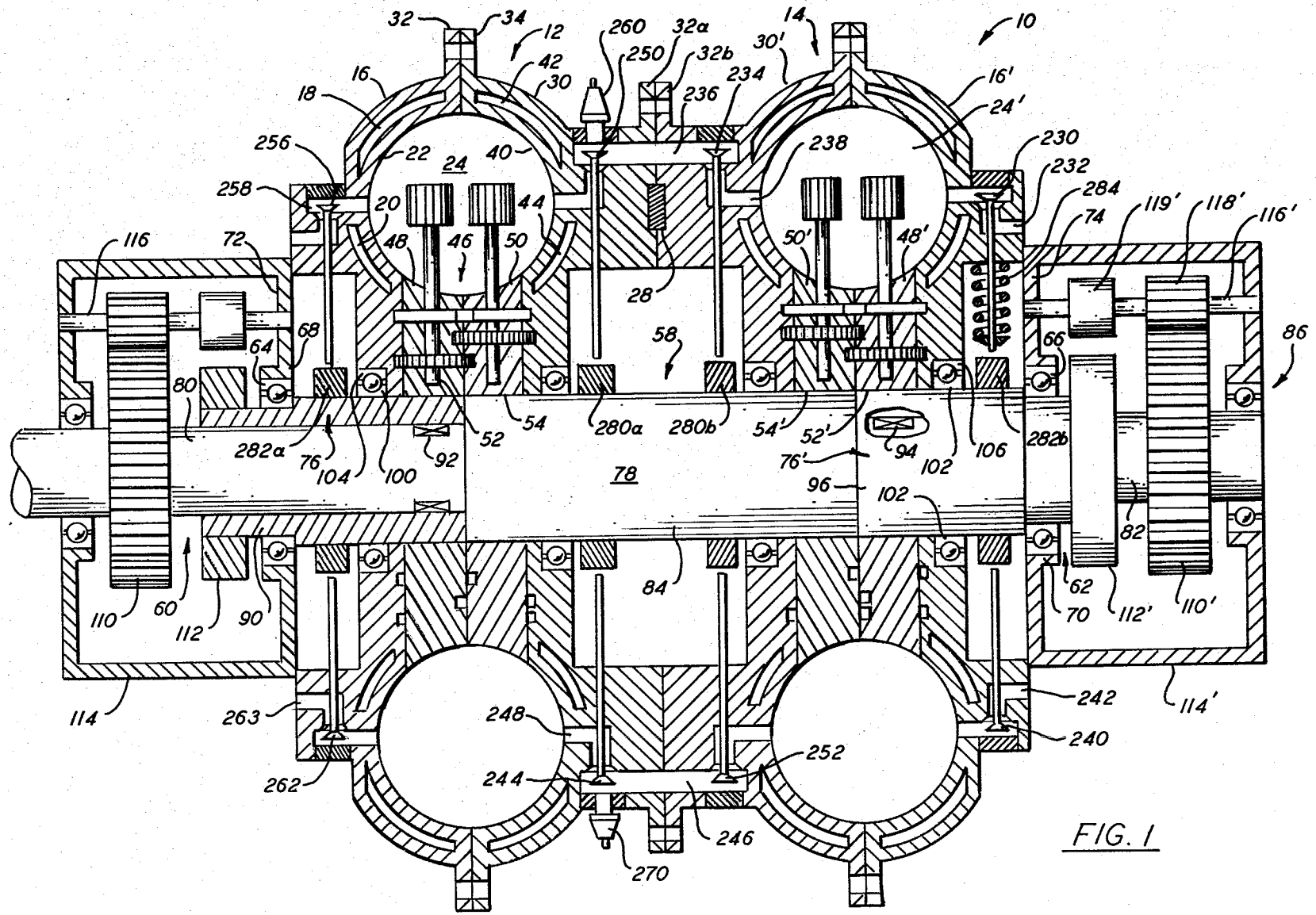
FIG. 1 is a sectional view of an engine constructed in accordance with various features of the invention.

Referring now to the drawings an internal combustion engine generally indicated at 10 is disclosed, which in the embodiment depicted in FIG. 1, comprises a pair of substantially similar banks 12 and 14. Bank 12 in the illustrated embodiment serves as the expansion bank and bank 14 serves as the compression bank. The compression bank 14 can be constructed as an independent unit and utilized as a compressor if driving forces are applied to its drive shaft, as will become more apparent hereinafter. Similarly, the expansion bank can be utilized as an independent unit.

The expansion bank 12 and the compression bank 14 are similar in construction in the disclosed embodiment and like reference numerals (normally prime numerals) will be used to describe similar parts. More specifically, each bank includes an outside case 16 which is substantially toroidal in configuration. The wall of the outside case 16 defines toroidal shaped coolant chambers 18 and 20 which are disposed at spaced locations from the arcuate surface 22 that defines a portion of the toroidal cylinder 24.

The outside case 16 is joined with a complementary configured inside case 30 in a sealing relationship as by a plurality of annularly spaced tabs 32 on the outside case, which define openings that register with the openings in the plurality of annularly spaced tabs 34 on the inside case. Suitable bolts (not shown) are used to join the tabs. The inside case 30 is substantially toroidal in outline and proportioned for mating with the outside case. More specifically, the inside case 30 defines a surface 40 which is arcuate, and defines with the surface 22 of the outside case, the toroidal cylinder 24 in which certain of the pistons, described in greater detail hereinafter, revolve and rotate.

The wall of the inside case 30 defines toroidal shaped coolant chambers 42 and 44 which are disposed proximate the cylinder surface 40. It will be noted that the coolant chambers 18, 20 and 42, 44 contain a coolant, such as a water and antifreeze mixture which is circulated proximate the cylinder 24 under the force of an conventional cooling system (not shown), such as a cooling system used in prior art automobiles. In applications where the compression bank is used independently of the expansion bank, it may be unnecessary to fabricate the outside and inside cases such that they incorporate the cooling chambers.

In the illustrated embodiment, the inside cases of the expansion bank and compression bank are fabricated to form complimentary configurations such that they can be readily joined to form the engine. To this end, suitable tabs **32*a* and 32*b*** are carried on the expansion and compression banks respectively, at annularly spaced locations such that they form registering openings adapted for receiving bolts therein to join the expansion and compression banks to form the complete engine. In applications in which it is desirable to have an independent compression or expansion unit, the inside cases can be closed by a suitable cover and the bank operated independently.

As is shown in FIG. 1, suitable insulation 28 can be interposed between the expansion and compression bank to assist in maintaining the compression bank cool and the expansion bank hot. Preferably, the insulation will be sandwiched between the banks such that there is no direct contact between them, however, only a small section of insulation has been shown for illustrative purposes.

The innermost central portion 46 (See FIG. 1) of the toroidal cylinder 24 defined upon joining the inside and outside cases 30 and 16, respectively, is closed by a pair of substantially circular discs 48 and 50 which rotate in opposite directions during operation of the engine. For purposes of this application, the discs include any member which serves to close the portion 46 of the cylinder. The discs will normally be solid, however, a solid perimeter supported by radially extending members will suffice. The perimeters 56 (See FIG. 23) of the discs 48 and 50 are complementary in shape and define with the arcuate surfaces 22 and 40 of the outside case and inside case, respectively, the toroidal cylinder 24, having a substantially circular cross-section. Each of the discs 48 and 50 are substantially circular in configuration in the illustrated embodiment, and define registering openings 52 and 54.

During operation of the engine, the discs 48 and 50 of the expansion bank rotate in opposite directions and transmit power to a drive shaft mechanism generally indicated at 58, which serves as a power take off for an apparatus, such as the wheels of a car, which are to be driven by the engine. The driving forces applied to the drive shaft mechanism by the expansion bank are applied through the discs 48' and 50' of the compression bank for controlling the introduction of a compressed fuel and air mixture into the combustion chambers. More specifically, the drive shaft mechanism extends through the registering openings 52 and 54 in the discs 48 and 52 of the expansion bank and the openings 52' and 54' in the discs 48' and 50', respectively, of the compression bank. The opposite end portions 60 and 62 of the drive shaft mechanism are rotatably received in bearings 64 and 66 carried in the collar portions 68 and 70, respectively, of the case covers 72 and 74 as shown in FIG. 1. More specifically, the drive shaft mechanism 58 includes external units or shafts generally indicated at 76 for the expansion bank and at 76' for the compression bank and an internal unit or shaft generally indicated at 78. The internal unit includes opposite end portions 80 and 82 which are joined to each other by a portion 84 of increased cross-sectional area disposed substantially centrally of the engine 10. As will be recognized in FIG. 1 the discs 50 and 50' of the expansion bank and compression bank, respectively, are fixedly secured to portion 84 of the internal shaft unit 78 such that upon rotation of these discs, the internal shaft rotates thereby imparting rotational movement to the opposite end portions 80 and 82 of this shaft. It will be recognized that the discs 50 and 50' revolve in the same direction. The external units or shafts 76 and 76' comprise first and further tubular section 90 and 96 which rotatably receive the end portions 80 and 82, respectively, of the internal shaft therein. In this connection, suitable bearing pairs indicated at 92 and 94 are provided. As shown in FIG. 1, disc 48 is fixedly secured to the tubular shaft portion 90 of the external shaft. Similarly, the discs 48' is fixedly secured to a similar tubular portion 96 of the external shaft which is disposed at the opposite end portions of the engine. To facilitate rotation of the portion 90 and portion 96 of the external shaft, bearings 100 and 102 are mounted in the openings 104 and 106 provided in the wall of the outside cases 16 and 16'. For reasons more clearly delineated hereinafter, the internal and external shafts rotate in opposite directions during the operation of the engine.

In order to control the timing of the revolutions of the pistons within the cylinders, revolution control means generally indicated at 86 are provided. In the illustrated embodiment, the revolution control means comprises suitable gears indicated at 110 and 110' which can be drivingly connected to the opposite end portions 80 and 82 of the internal drive shaft, respectively. Suitable sheaves or sprockets 112 and 112' are fixedly secured to the end portions 90 and 96 of the external shaft for rotation in the opposite direction. In this connection, gear housings 114 and 114' which incorporate the case covers 72 and 74 in the depicted embodiment are provided. As shown in FIG. 1, each of the gear housings is provided with bearings which support the opposite end portions of the internal shaft unit 78. Moreover, suitable jack shafts 116 and 116' are rotatably mounted within the housings 114 and 114', and carry gears 118 and 118' and sheaves 119 and 119' which can be interconnected to gears 110 and 110', and sheaves 112 and 112' as necessary or desired. It will be recognized that the relative revolutionary position of the discs, and accordingly the pistons carried thereby, is regulated by the control means 86. As necessary or desired, suitable electrical, electronic, or hydraulic control means may be used to regulate the revolutionary timing of the discs and their respective pistons.

Pistons generally indicated at 120*a–d* are mounted on each of the discs and revolve in a predetermined direction in each of the cylinders. Moreover, in one embodiment the pistons revolve in opposite directions and are mounted in cooperating pairs on the discs in the compression and expansion banks. As will be delineated hereinafter, however, it is only necessary for one piston to revolve. As indicated in FIGS. 2–9 the pistons 120 which revolve within the toroidal cylinders of the engine are substantially hemispherical in outline. More specifically, each piston includes a piston head which is proportioned such that upon rotation of the pistons during revolution through the cylinder, the pistons can pass within the cylinder such that certain pistons within a cylinder can travel in opposite revolutionary directions. More specifically, the pistons carried by the cooperating discs within a given bank revolve in opposite directions.

Figure 4:
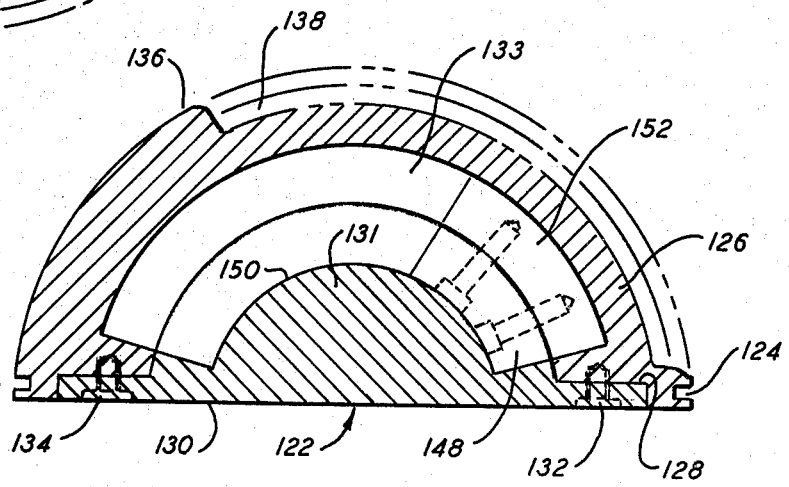
FIG. 4 is a cross-sectional view of the piston head shown in FIGS. 2 and 3.
Figure 5:
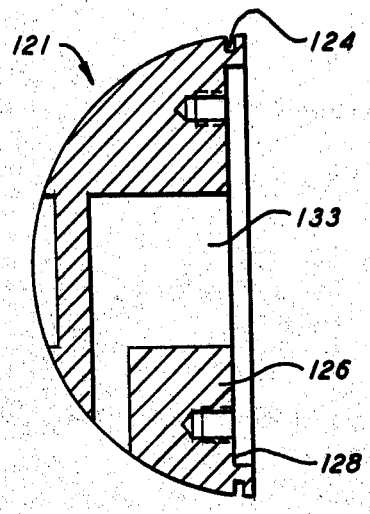
FIGS. 5–17 illustrate various views and components of one embodiment of a piston used in the engine shown in FIG. 1.
Figure 6:
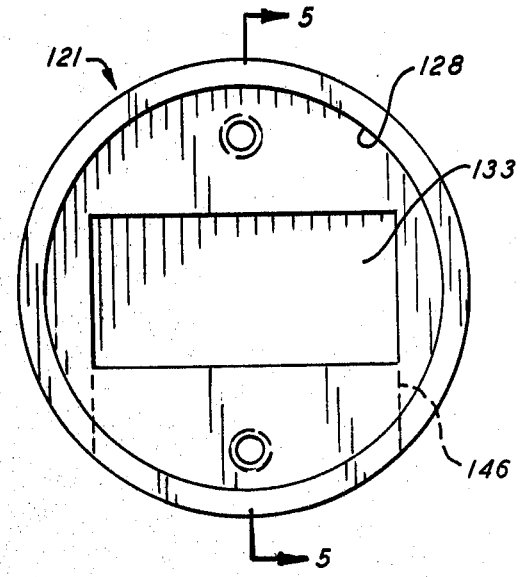
Figure 7:
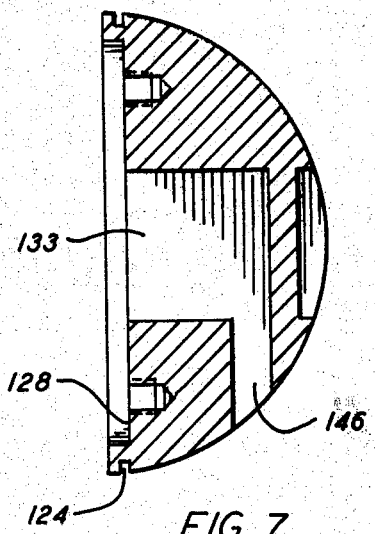
Figure 14:
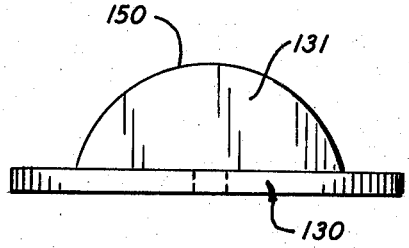
Figure 16:
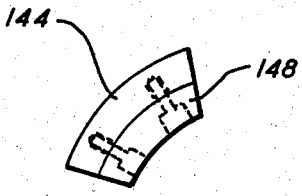
Figure 17:
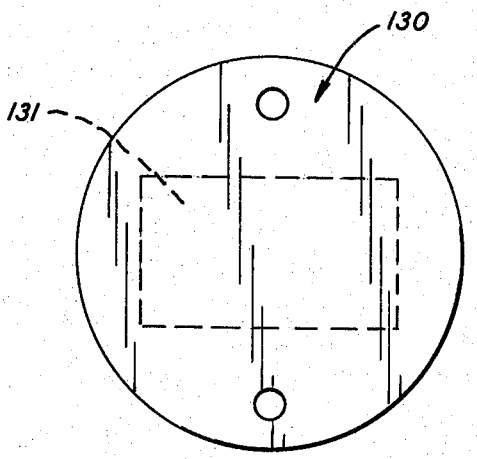

The illustrated piston 120 (See FIG. 2) includes a piston head 121 which is substantially hemispherical in shape and includes a substantially circular front face 122 which is proportioned such that this face of the piston substantially seals the cylinder 24 during travel of the piston (revolution) around the cylinder, when the direction of travel of the piston is substantially perpendicular to the face 122 of the piston. In this connection an annular recess 124 is provided proximate the perimeter of the piston face and is adapted for receiving a suitable sealing ring (not shown) similar to the rings used to seal ordinary pistons used in internal combustion engines. The wall 126 of the piston head defines a recessed circular shoulder 128 (FIG. 4) which is adapted for receiving the face plate 130 which is secured thereon as with the recessed bolts 132 and 134 such that the face 122 of the piston head is substantially smooth. As shown in FIGS. 4, 14 and 17 the face plate 130 includes a section 131 which is circular in outline which is received within the opening 133 provided within the wall of the piston head. The arcuate surface of the section 131 of the face plate serves to assist in guiding the rotation of the piston head 121 within the cylinder.

Figure 2:
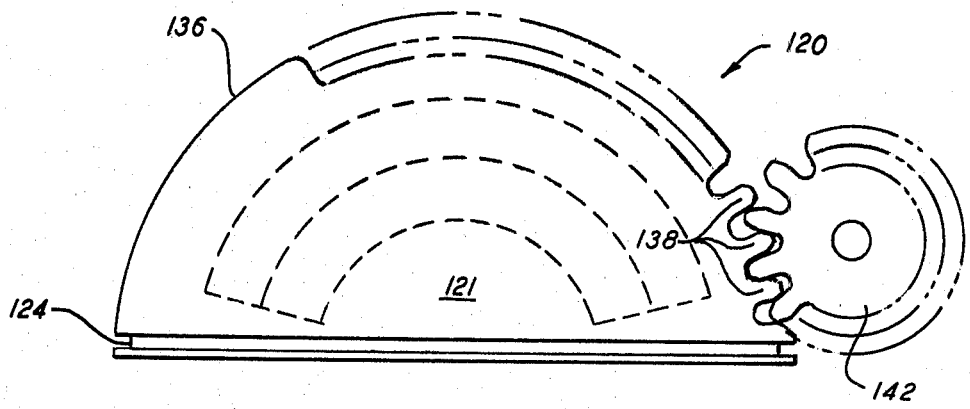
FIGS. 2 and 3 are plan views of a piston head in a position for passing and in a position for movement through the cylinder in a direction substantially perpendicular to the leading face of the piston head, respectively.
Figure 3:
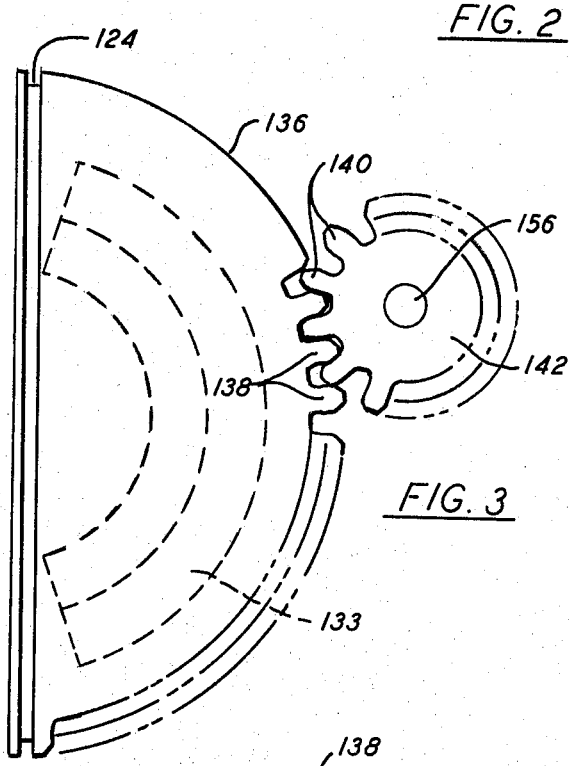
Figure 8:
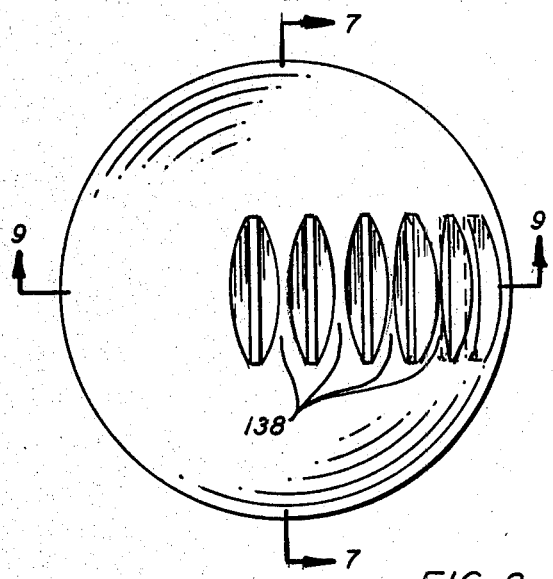
Figure 9:
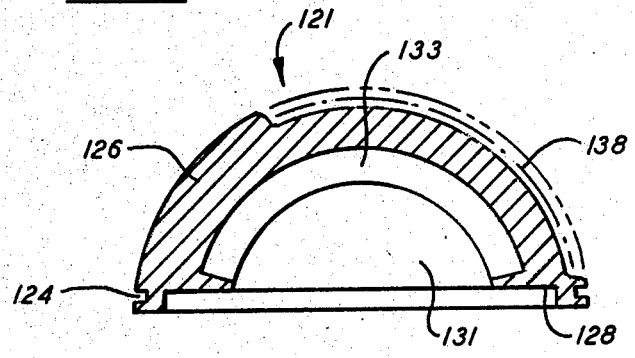
Figure 10:
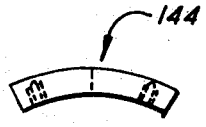

As indicated in FIGS. 2, 3 and 8 the external surface 136 of the piston head 121 is provided with a plurality of gear teeth 138 which are adapted for meshing with the teeth 140 of the pinion 142 which is carried by a disc as will be described in greater detail hereinafter. The rotational movement of the pinion 142 serves to rotate the piston 120 within the cylinders such that the pistons can pass therein as necessary or desired.

Figure 11:
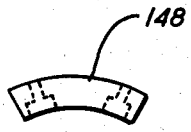
Figure 12:
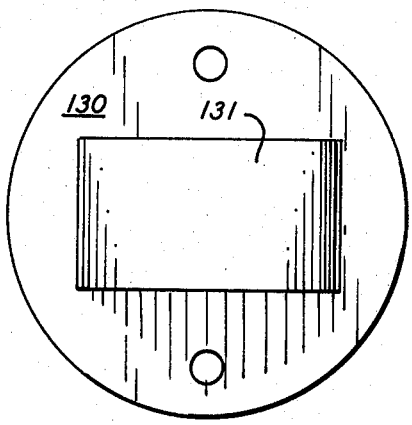
Figure 15:
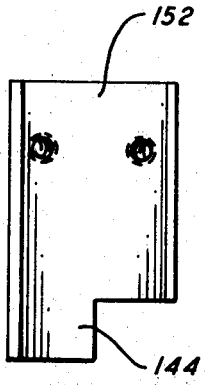
Figure 13:
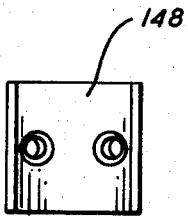
Figure 18:
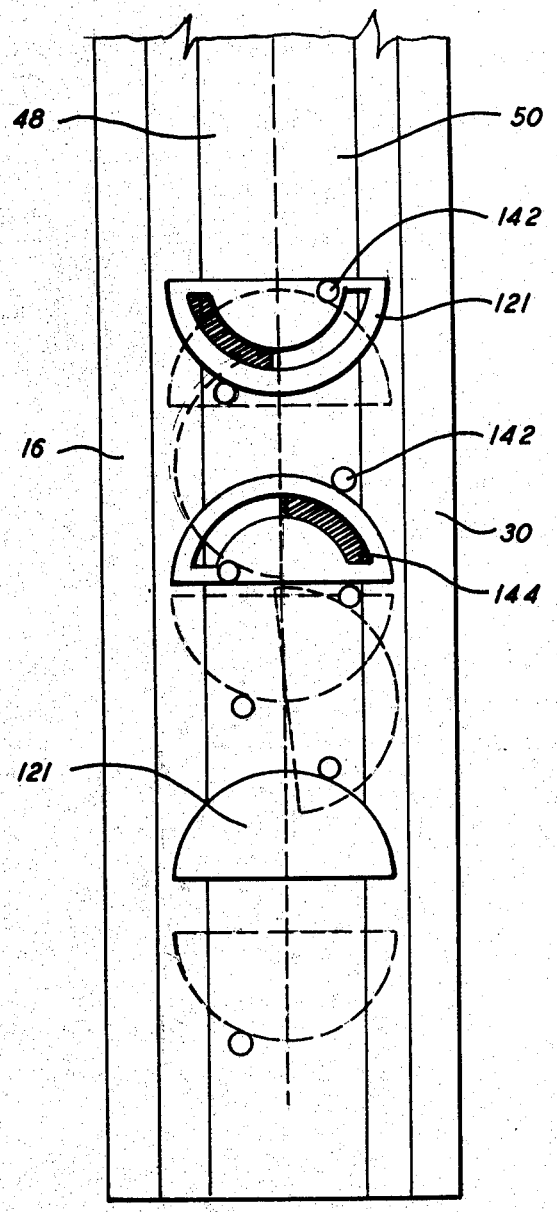
FIG. 18 is a plan view illustrating motion of the pistons which revolve, with a portion of the cylinder broken away for illustrative purposes.

Each piston head 121*a–d* is carried by a disc and drivingly connected to its respective disc through a suitable stud 144 (See FIGS. 18 and 24) having one end which is fixedly secured in the disc perimeter and the opposite end which is received in the slot 146 defined by the wall 126 of the piston head. More specifically, the stud 144 carries at its outboard end 152 a retainer block 148 (FIGS. 4, 11 and 13) which is arcuate and slidably engages the arcuate surface 150 (See FIG. 14) defined by the substantially circular section 131 of the plate 130. The arcuate outboard end 152 is joined with the arcuate retainer block which guides the rotational movement of the piston head as it is turned by the pinion 142. The outboard end of the stud 144 and the block 148 are received within the opening 133 provided within the wall of the piston head.

It will be recognized that upon pressure being exerted against the face 122 of the piston head the arcuate surface 150 will be forced against the retainer block 148 which is secured through the stud 144 to the disc. In this connection the force applied substantially perpendicular to the face of the piston head will be transmitted into rotational forces exerted against the disc thereby revolving the disc and the respective drive shaft until which carries the disc.

Means are provided for controlling the rotation of at least one of the pistons within the toroidal cylinders during operation of the engine such that the piston heads are maintained in a proper rotational position or mode at all times. Also, it will be noted that the pistons must be rotated at predetermined locations along their travel for purposes of passing (passing mode). In this connection, the pinion 142 includes teeth which mesh with the gear section 154 having teeth 138 carried on the piston head. More specifically, the pinion 142 is mounted on a shaft 156 which carries at its opposite end portion a further gear 160 and a cam 162 (See FIGS. 20 and 21*a–b*). The cam 162 and the gear 160 are fixedly secured to the shaft 156. The cam and gear are rotatably mounted with respect to the disc in the opening 164 having a portion 166 of increased diameter which is proportioned for rotatably receiving the gear 160 and the cam 162.

In order to control the mode of operation or rotation of the piston heads, means are provided for selectively engaging the gear 160 and the cam 162 during revolution of the discs and the pistons carried thereby such that the pistons will be positioned at a proper rotational position within the toroidal cylinders at all times during operation of the engine. In this connection, the wall of each case juxtaposed with a disc rotating adjacent the case wall is provided with means for selectively rotating the piston heads. Moreover, in one embodiment a gear section or segment is provided on the cooperating disc to assist in rotating the pistons from the passing mode to the expansion/compression mode such that the face 122 of the pistons is substantially parallel to the direction of travel of the pistons. The face 170 (See FIGS. 19 and 22) of the case proximate the pinion gear whose rotational position is controlled is provided in the illustrated embodiment with segments or sections of gears and slides which selectively engage the gear 160 and the cam 162 on each of the shafts 156 for rotating the pinion 142 and imparting rotational forces to the piston heads. Moreover, the spacing of the slides and gear sections serves as a timing aid for the rotation of the pistons at preselected intervals such that at least one of the pistons is positionable in a passing mode whereby the rotatable piston can revolve past its cooperating piston during revolution of the disc. Further, the pistons are positionable in the compression/expansion mode such that the opposite end portions of the chamber defined between cooperating pairs of pistons are defined by the pistons themselves. It will be noted that the compression mode in the compression bank or a compressor is the counterpart of the expansion mode in the expansion bank or utilization of the device as an independent means for expanding a fluid, i.e. for driving forces. In the compression/expansion mode the faces 122 of the piston heads are substantially parallel to the direction of travel of the pistons (revolution) through the cylinders.

To enhance the meshing of the teeth and more particularly, to increase the amount of contact between the teeth of the gears 142 and 160, these gears can be beveled or shaped to be complementary with their associated teeth on the piston heads and/or the face of the casings.

Figure 20:
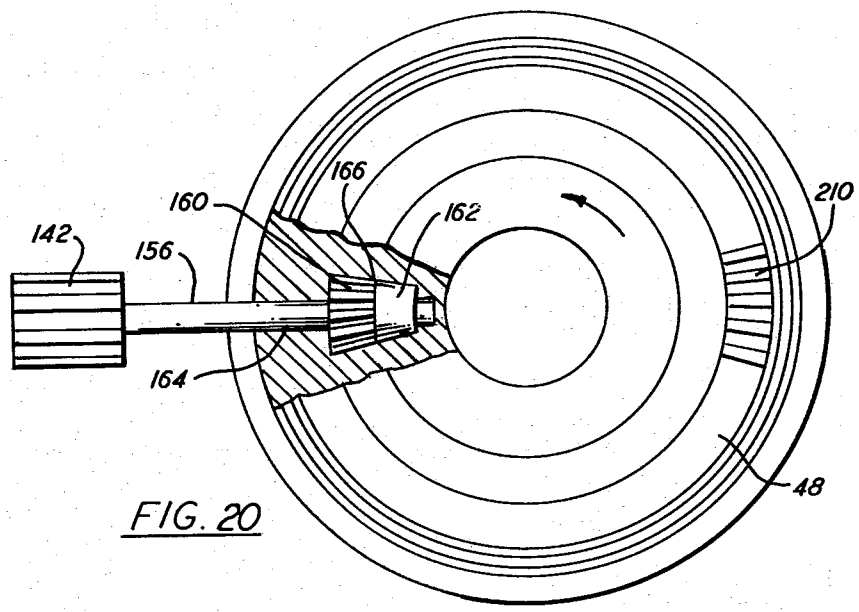
FIGS. 19 and 20 illustrate side elevation views of the face of the case and the face of a disc including gear sections and slides which control the rotation of the pistons in one embodiment of the invention.
Figure 19:
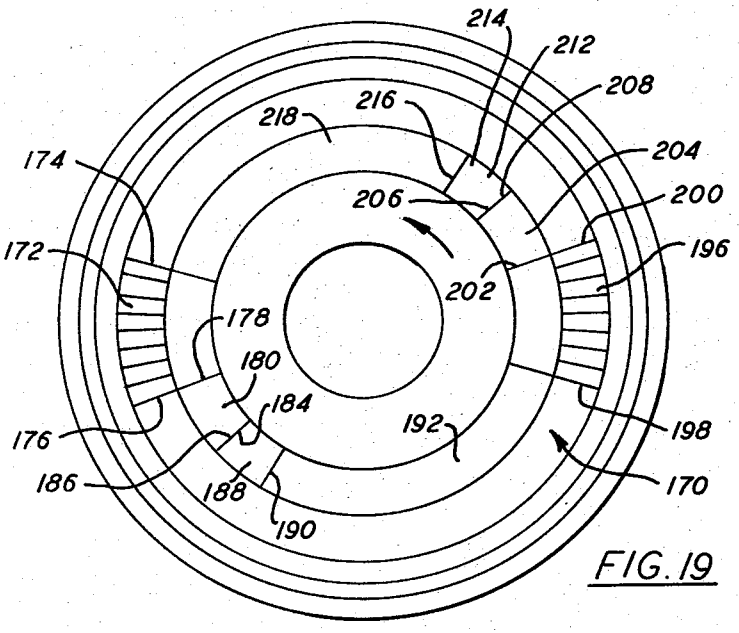

Assuming that the revolutionary direction of the piston carried on the disc 50 is indicated by the arrow in FIGS. 19 and 20, the gear section 172 serves to engage the teeth of the gear 160 for rotation of the piston head. More specifically, upon the gear 160 carried by a disc, revolving until it reaches the beginning 174 of the gear section 172, the gear teeth of the gear section 172 engage the gear 160, and as the disc 50, for example, revolves the gear teeth of the gear 160 rotate and impart rotational forces to the pinion 142 through the shaft 156 until the face 122 of the piston head is perpendicular to the direction of revolution of the piston head within the toroidal cylinder (See FIG. 3). This position is obtained upon the gear teeth of gear 160 reaching the end 176 of the gear section 172. As the teeth of the gear 160 disengage the gear section 172 at its end 176, the cam 162 encounters the end portion 178 of the slide 180 which engages the flat surface 182 (see FIG. 21*a*) of the cam and maintains the piston head in its rotated position as the pistons pass during movement of the cam from end 178 until it reaches the end 184 of the slide 180. Thus, as the cam moves across the slide 180, the pistons are passing. Upon reaching the end 184 of the slide 180, the cam reaches the end 186 of the recess 188, which allows the gear 160 to turn or rotate therein. Rotation of the gear 160 as the cam is within the recess 188 is caused by the bevel gear 160 engaging a gear section (not shown) on the adjacent disc which rotates the pistons back into their original positions or the compression/expansion mode such that the face of the piston is substantially parallel to the direction of its revolutionary travel of through the toroidal cylinder. Thus, as the cam passes between the locations on the case face indicated by 186 and 190, the piston is rotated into position (compression/expansion mode) such that its face stays parallel to its travel. During this time the recess 188 receives the acruate portion 192 of the cam 162. Upon reaching the position indicated at 190, the flat surface 182 of the cam 162 engages the slide 192 which maintains the piston head in a direction of travel perpendicular to the rotation of the disc.

As the revolution of the disc continues, the gear 160 will engage the gear section 196 on the case and travel between ends 198 and 200 of this gear section 196. This gear section 196 serves to rotate the piston head 121 until its face 122 is perpendicular to the direction of travel of the piston during revolution through the cylinder (passing mode). This position is obtained upon the gear teeth of gear 160 reaching the end 200 of the gear section 196. As the teeth of the gear 160 disengage the gear section 196 at its end 200, the flat surface 182 of the cam 162 encounters the end 202 of the slide 204 which engages the surface 182 of the cam and maintains the piston head in its rotated position (passing mode as shown in FIG. 2) as the pistons pass during the travel of the cam from end 204 to end 206 of the slide 204. Rotation of the gear 160 as the cam 162 is within the recess 204 is caused by the bevel gear 160 engaging a gear section (not shown) on the adjacent disc which rotates the pistons back into their original positions or compression/expansion mode such that the face of each piston is substantially parallel to the direction of its revolutionary travel. Thus, as the cam 162 moves across the slide 204, the pistons are passing. Upon reaching the end portion 206 of the slide, the cam 162 reaches the end 208 of the recess 212, and the bevel gear 160 engages a gear section, such as section 210, which is rotating in the opposite direction. This gear section 210 (FIG. 20) rotates the piston back into its original position such that the face of the piston is substantially parallel to the direction of revolutionary travel of the pistons through the toroidal cylinder. Thus, as the cam passes through the recess 212 between the locations on the case face 170, indicated by 208 and 214, the piston is rotated into position such that its face remains parallel to its direction of travel. Upon reaching the position indicated at 216, the flat surface of the cam 162 engages the slide 218 which maintains the piston head in a direction of travel parallel to the revolution of the disc. The rotational cycle of the pistons repeats itself upon the gear 160 reaching the gear section 174.

It will be recognized that the rotation of pistons just described is such that the pistons pass two times during each revolution around the cylinder. The pistons are, however, arranged in cooperating pairs and more or less passings may be desired during one revolution. Accordingly, the spacings of the gear segments on the face 170 and the opposing disc can be controlled to allow one passing per revolution or a multiplicity of passings per revolution. Moreover, alternate means such as hydraulics or electrical means can be used to rotate the pistons between their passing and compression/expansion modes.

The engine operation will now be described in connection with the movement of the pistons, the injection of a fuel/air mixture into the engine and the position of the valve means which control the exhausting and intaking of the fuel. The starting position of a stroke in the compression bank will be defined as the position of the pistons shown with solid lines in FIGS. 26 and 28. The starting position in the expansion bank will be defined as the relative position of the pistons indicated with solid lines in FIG. 25 and 27. It is again pointed out that the compression bank and the expansion bank can be used independently as necessary or desired. For purposes of a reference, the upper portions of the compression and expansion cylinders, correspond with the upper portion of the compression and expansion cylinders in FIG. 1.

Referring now to the operation of the valve means during the engine cycles (See Table A and B), at the starting point the compression pistons are at the top portion of FIGS. 1 and 26 positioned such that their faces are parallel to the direction of travel around the cylinder. The expansion pistons are at the lower portion (bottom) of FIGS. 1 and 25, they have just passed and are ready to begin the expansion stroke travelling upwardly in opposite directions. At the starting position in the compression bank, valve 230 (See FIG. 1) which controls the flow of the fuel air mixture through the intake port 232 will be open. In normal operation, the intake port will be mounted in fluid communication with a suitable carburetor (not shown). Valve 234 which serves to control the flow of the air and fuel mixture into the combustion chamber 236 from the compression bank through the port 238 will be closed. Valve 240 which controls the flow of the fuel air mixture through the intake port 242 will be closed. In normal operation this port 242 will be mounted in fluid communication with a suitable carburetor (not shown). Valve 252 will be open. This valve is the counterpart of valve 234 for the combustion chamber 246. Valve 244 which controls the flow of the expanding or burning gases into the expansion bank from the combustion chamber 246 through the port 248 will be closed.

The compression piston heads **121*c* and 121*d* will then move to the opposite side (180°) of the cylinder, pass each other and reposition as shown in the solid lines in FIG. 28. The pistons are then ready to return to the starting position. Valve 230 will close, valve 234 will open, valve 240 will open, and valve 250 will close. Valve 252 will close. Valve 250 controls the flow of the expanding fuel mixture from the combustion chamber 236 into the cylinder of the expansion chamber. Moreover, valve 230 controls the flow of the fuel mixture through the intake port 232 will be closed. The pistons will then revolve toward the starting point forcing the fuel mixture in the compression cylinder 24' through valve 234 into the combustion chamber 236. As the pistons are returning toward the starting position, a vacuum is formed behind them pulling the fuel mixture through the intake port 240. The pistons of the compression bank will then repeat the sequence of operation similar to the first cycle, and fuel will be forced through the valve 252 into the combustion chamber 246**.

The expansion pistons will be timed at some revolutionary (lag or lead) angle, such as 90° from the compression pistons. This will allow the combustion chambers 236 and 246 to be filled with fuel and the valves 234 and 250 to be closed awaiting ignition. The expansion pistons will be positioned as shown in the solid lines in FIGS. 25 and 27 (at the top of the cylinder as shown in FIG. 25), and ready to begin a cycle. This position will be defined as the starting position for reference purposes. Valve 256 which controls the flow of gases through the exhaust port 258 will be closed and valve 244 will be closed. Moreover, valve 262 which controls the flow of gases through the exhaust port 263 will open. The spark plug 260 communicating with the combustion chamber 236 will ignite the fuel in chamber 236 and valve 250 will open allowing the ignited fuel to expand into the chamber 264 (See FIGS. 25 and 27) between the piston heads **121*a* and 121*b*. As necessary or desired valve 250 can open prior to the ignition of the fuel in the combustion chamber 236. The expanding fuel will act against the flat surfaces 22*a* and 22*b* (See FIG. 25) of the piston heads forcing them around the cylinder to the opposite side (180° from the starting position). At this position, the pistons will pass, and reposition as shown at 268 in FIG. 27 such that their faces define the chamber 264. Valves 250 and 262 will close and valve 256 will open. The fuel in chamber 246 will then be ignited by the spark plug 270 and valve 244 will open allowing the ignited fuel to expand into the expanding chamber 264 between the expansion pistons 121*a* and 121*b* forcing them toward the starting position and forcing the spent fuel from the first stroke out valve 256 and through the exhaust port 258** to the atmosphere. The expansion pistons will return to the starting position, pass each other and reposition w.th their faces opposed and ready to begin another cycle.

The operation of the engine through one revolution of the pistons within the compression bank and pistons within the expansion bank has been described in connection with one pair of cooperating pistons in each bank. Moreover, the pistons pass through two cycles during each revolution around the cylinder. As necessary or desired, additional cooperating pairs of pistons could be mounted within each cylinder.

In the above described operation, it will be noted that the expansion bank pistons lag behind the compression pistons. This lag allows the fuel/air mixture to be introduced under pressure into the combustion chamber. The intake valves of the combustion chambers then close. The expansion bank pistons move to a position for the beginning of the stroke, the valve (250 or 244) then opens allowing the ignited fuel to enter between the expansion pistons and forces them in opposite directions. Moreover, the lag time can be controlled to assure proper and complete burning of the fuel before the expansion stroke is terminated.

Means are provided for controlling the various opening and closing movements of the valves. In this connection suitable cam members 280*a–b* and 282*a–b* are provided on the internal and external shafts, respectively. These cam members include annularly spaced depressions and raised areas which act against the various valve stems for timing and controlling the opening and closing the valves. It will be recognized that suitable valve springs, such as the compression spring 284 used in connection with the valve 230, can be mounted on back of the valve stems for controlling the valve closing.

It will be recognized by those skilled in the art that the expansion bank of the present engine can be driven by injecting steam into the expansion cylinder upon the pistons being positioned to being the expansion or power stroke. Moreover, as necessary or desired steam mixed with an ignited and expending fuel mixture can be injected into the expansion cylinder at the beginning of the expansion stroke to supplement the power. In one embodiment, the steam is generated by the water circulating through the coolant chambers. This water which is heated to temperatures above its boiling point expands upon being inserted or injected into the combustion chamber where the pressure is less. Thus, supplemental power can be provided to the engine.

While the operation of the engine has been described in connection with two pistons in each cylinder, i.e., one piston mounted on each disc, it will be recognized that a plurality of cooperating pairs of pistons can be utilized and the means for controlling the rotation of the pistons during their revolutionary paths around the cylinder altered to define the expanding and contracting chambers at the proper times.

In certain applications, it is desirable to enhance the evacuation of the combustion chamber of the expended gases prior to the introduction of a fresh fuel and air mixture therein. To this end, an alternate combustion chamber 246*a* is shown in FIG. 34 which is compressible. A piston 290 includes a piston head 292 which is mounted at the outboard end of a shaft 294 that is slidably received in a bore 296 defined by the inside cases of the expansion and compression banks. End portion 298 of the shaft 294 engages a cam 300 mounted on the internal unit 78 of the drive shaft mechanism 58. A spring 302 serves to move the piston head to its expanded position (Shown in FIG. 34) when the cam 300 does not engage the shaft 294. It will be recognized that the cam 300 will be positioned on the shaft such that the piston head 292 will collapse the chamber 246*a* subsequent to the ignition of the fuel therein to assist in cleaning the expended fuel therefrom.

Figure 30:
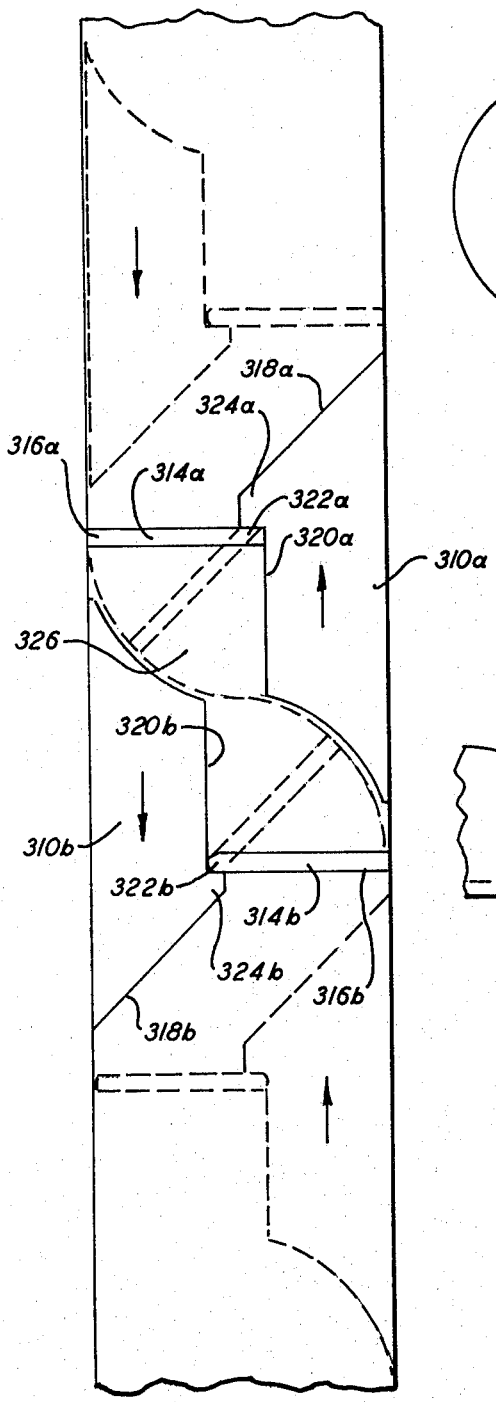
Figure 31:
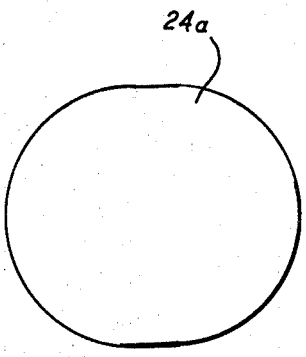
Figure 32:
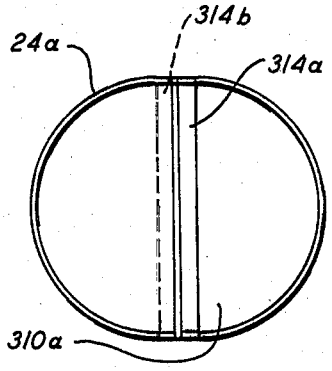
Figure 33:
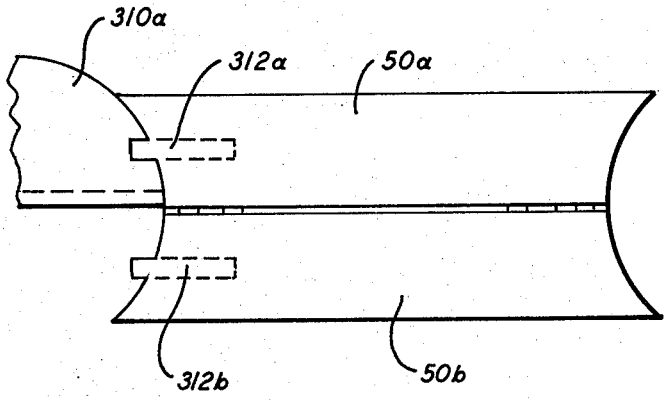

An alternate embodiment of the pistons is illustrated in FIGS. 30 and 33. More specifically, the pistons shown in FIG. 30 are designed such that rotation is not necessary for the passing of the pistons in the cylinder. The discs 50*a* and 50*b* carry pistons 310*a* and 310*b*, respectively, which are secured on their respective discs as by studs 312*a* and 312*b*. These pistons are arcuate to close the cylinder 24*a* whose outline is shown in FIG. 31 and carried along an arc of the perimeter of their respective disc and define a substantially semicircular outline. More specifically, the outline of each cylinder closes one end of the chamber in the cylinder within which the pistons revolve. Each piston includes a section 314 which is pivotally mounted on the piston and is proportioned to completely close the cylinder cross section when the section 314 is in the open position as shown in FIG. 32. In operation, piston 310*a* rotates in the direction indicated by the arrow in stretch-out view of FIG. 30 and piston 310*b* rotates in an opposite direction as indicated by its arrow in FIG. 30. When the outboard end portion 316 of the section 314 engages the sloped leading portion 318 of the cooperating piston, this hinged section is pivoted such that the pistons can pass. This passing position of the pistons and their hinged sections is shown in FIG. 32. It will be noted that each piston includes a recessed area 320 which receives the pivotal sections as the pistons pass. After the piston section 314 have passed each other, a spring, or the like, urges the piston sections 314 toward their open position by rotating the edges 322 of the sections 314 about the shoulder 324 to which the section 314 is pivotally secured.

Upon the pistons reaching the position shown by the solid lines in FIG. 30, an ignited or expanding fuel air mixture is introduced into the chamber generally indicated at 326 to begin the expansion stroke.

The relative revolutionary position of the pistons within the cylinders will be controlled by revolution control means such as the means 86 described hereinabove. As necessary or desired, other means, such as hydraulic, electric or electronic control means could be employed. Moreover, the discs 50*a* and 50*b* can be interconnected through gear means housed within the wall means of the engine to control the relative revolutionary position of the pistons.

Details of the valve operations are shown in Tables A and B for compression and expansion banks of an engine which completes two cycles driving each revolution of the pistons about the cylinder. It will be recognized that there is a timing range during which this engine will operate suitably. More specifically, the expansion pistons can lead the compression pistons slightly such that the expansion pistons are positioned and ready to begin the expansion stroke prior upon the counterpart compression pistons beginning the passing mode subsequent to the closing of valve 234 or valve 252. Moreover, the relative revolution of the compression and expansion pistons can be timed such that the expansion pistons lag (with respect to their revolutionary position) behind the compression pistons. The expansion pistons can lag behind the compression pistons for up to about 180° or until the valve 234/250 must open to begin the next compression stroke in the compression bank. Thus, the only correlation between the compression bank and the expansion bank is that the combustion chambers 236/246 must contain fuel with its associated valves closed, i.e. valves 234 and 250 for chamber 236, when the expansion pistons are positioned and ready to receive the ignited fuel. Moreover, the rate at which the fuel burns will be used to determine the timing.

In certain devices for compressing/expanding a fuel or in internal combustion engines constructed in accordance with various features of the invention it will be necessary or desired to construct the engine or device such that only one of the cooperating pairs of pistons revolves within the cylinder. To this end, an alternate embodiment of the invention is disclosed in FIGS. 35 and 36. More specifically, the alternate cylinder and piston arrangement shown in FIGS. 35 and 36 incorporates one piston 120*i* which is mounted on the perimeter 56*i* of the disc 50*i* carried on the drive shaft mechanism 58*i*. The piston 120*i* includes a cross-section which closes the cross-section of the cylinder 24*i*, and revolves together with the disc 56*i* during the engine cycles. The piston 120*i* cooperates with a further piston or more specifically, piston partition which is selectively moved into and out of the cylinder 24*i* such that the opposite end portions of the expanding chamber 264*i* are defined by the pistons 120*i* and 120*k*. The compressing chamber 265*i* includes opposite end portions defined by the opposite faces of the pistons 120*k* and 120*i*.

Means generally indicated at 320 are provided for controlling the mode of operation of the pistons during the cycles of the engine such that the pistons are selectively placed in a passing mode and a compression/expansion mode at predetermined times during the revolution of the piston 120*i*. More specifically, in the passing mode the piston 120*k* is raised and removed from the cylinder 24*i* such that piston 120*i* can revolve past the cooperating piston or gate 120*k*. during the disc revolution. Depending on whether the device is used to compress or expand a fluid, the pistons are positionable in a compression/expansion mode such that the opposite end portions of the chamber 265*i* and 264*i* defined between the cooperating pairs of pistons are defined by the respective pistons themselves. It will be noted that each piston is proportioned for sealing the cross-section of the cylinder upon being positioned in the compression/expansion mode.

In the diagrammatic illustration of FIGS. 35 and 36, the piston 120*k* is raised out of the cylinder 264*i* by a suitable cam 320*i* which engages the end portion 322*i* of member 324*i* intergally formed with the piston 120*k*. This cam 320*i* is mounted on the drive shaft mechanism 58*i* and raises and lowers the piston 120*k* to position it in its passing and compression or expansion modes. A suitable spring 326*i* serves to bias the piston 120*k* toward its closed position by acting on the flared end portion 328*i* of the member 322*i*. This member 322*i* reciprocated within the opening 330*i* defined by the portion 332*i* carried by the apparatus case 16*i*.

In operation, the piston 120*k* raised to allow the piston 120*i* to pass (passing mode) as the disc 50*i* revolves carrying piston 120*i*. A fuel/air mixture is introduced into the chamber 264*i* through the valve controlled port 248*i* and ignited as by a spark plug (not shown in the diagrammatic illustration). As the piston 120*i* revolves under the force of the expanding fuel, spent fuel is exhausted through the valve controlled port 263*i* from the chamber 265*i* (the compression/expansion mode). The piston again raises allowing piston 120*i* to pass the piston 120*k* and the cycle begins again.

It will be recognized by those skilled in the art that suitable sealing means such as rings or the like will be used to seal the cylinders and the areas between the discs and the cases. For example, rings 340, 342 and 344 are shown in FIG. 22 as suitable means for providing a seal between the cases and discs. The rings are preferably toroidal in shape and extend around the perimeter of the discs.

It will be recognized that while one pair of cooperating pistons are shown, a plurality of pairs of cooperating pistons can be utilized as necessary or desired. Moreover, the piston 120*k* can readily be controlled by suitable hydraulic, electronic or electric means instead of the means 86*i* illustrated employing a cam. Moreover, a magnetic coil or slave hydraulic cylinder could be used to control the raising and lowering of the piston 120*k*.

While particular preferred embodiments of the invention have been described as illustrative of the present invention, various modifications may be made within the scope of the invention. For example, certain of the mechanical functions of the apparatus, such as the timed rotation of the pistons and the timed operation of the valves can be controlled electrically, electronically, or hydraulically.

TABLE A

| | VALVE POSITIONS | | | | | | | |
|---|---|---|---|---|---|---|---|---|
| | COMPRESSION VALVES | | | | EXPANSION VALVES | | | |
| | #230 | #240 | #234 | #252 | #250 | #244 | #256 | #262 |
| Expansion Pistons At Top Beginning Of Stroke (Expansion Mode) | OPEN | CLOSED | CLOSED | OPEN | OPEN | CLOSED | CLOSED | OPEN |
| Expansion Piston Near Bottom Ready To Turn and Pass | CLOSES | CLOSED | CLOSED | CLOSES | CLOSED | CLOSED | OPEN | CLOSED |
| Expansion Pistons At Bottom Position (Passing Mode). | CLOSED | OPEN | OPEN | CLOSED | CLOSED | CLOSED | OPEN | CLOSED |
| Expansion Pistons Near Top Ready To Turn and Pass | CLOSED | CLOSES | CLOSES | CLOSED | CLOSED | CLOSED | OPEN | CLOSED |
| Expansion Pistons At Top (Passing Mode) | CLOSED | OPEN | CLOSES | CLOSED | CLOSED | CLOSES | CLOSES | CLOSED |

TABLE B

| | VALVE POSITIONS | | | | | | | |
|---|---|---|---|---|---|---|---|---|
| | COMPRESSION VALVES | | | | EXPANSION VALVES | | | |
| | #230 | #240 | #234 | #252 | #250 | #244 | #256 | #262 |
| Compression Pistons At Top Beginning Of Stroke (Compression | | | | | | | | |

TABLE B-continued

| | VALVE POSITIONS | | | | | | | |
|---|---|---|---|---|---|---|---|---|
| | COMPRESSION VALVES | | | | EXPANSION VALVES | | | |
| | #230 | #240 | #234 | #252 | #250 | #244 | #256 | #262 |
| Mode) Compression Pistons Near Bottom Ready To Turn And Pass | OPEN | CLOSED | CLOSED | OPEN | OPEN | CLOSED | CLOSED | OPEN |
| Compression Pistons At Bottom Position (Passing Mode) | CLOSES | CLOSED | CLOSED | CLOSES | CLOSED | CLOSED | OPEN | CLOSED |
| Compression Pistons Near Top Ready To Turn And Pass | CLOSED | CLOSES | CLOSES | CLOSED | CLOSED | OPEN | OPEN | CLOSED |
| Compression Pistons at Top (Passing Mode) | CLOSED | CLOSES | CLOSES | CLOSED | CLOSED | CLOSED | OPEN | CLOSED |
| | CLOSED | CLOSING | CLOSES | CLOSED | CLOSED/ OPEN | CLOSES | CLOSES | CLOSED/ OPEN |

What is claimed is:

1. A device for compressing/expanding a fluid comprising:

wall means defining at least one toroidal cylinder, at least one pair of discs mounted for revolving with respect to said cylinder and with respect to each other, a drive shaft mechanism carrying said discs such that said discs revolve with respect to said cylinder, piston means cooperating to define a compressing/expanding chamber during revolution of said discs, said piston means including at least a cooperating pair of pistons, each of said pistons being mounted on a respective disc which revolves within said cylinder, means for controlling the mode of operation of said pistons such that said pistons are selectively placed in a passing mode and a compression/expansion mode at predetermined times during the revolution of said piston means and said piston means being positionable in a passing mode such that at least one of said piston means can revolve past its cooperating piston means during revolution of said discs, and said pistons being positionable in a compression/expansion mode such that the opposite end portions of the chamber defined between cooperating pairs of piston means are defined by said cooperating piston means, each piston means including a piston head proportioned for sealing the cross-section of said cylinder upon being positioned in said compression/expansion mode.

2. The device of claim 1 including valve means for selectively controlling the flow of fluid into said cylinder and for selectively controlling the flow of said fluid from said cylinder.

3. The device of claim 2 including means for controlling the operation of said valve means.

4. The device of claim 2 wherein said fluid is a fuel/air mixture and including means for introducing said fuel/air mixture into said cylinder at predetermined times and further including means for igniting said fuel/air mixture such that said ignited mixture acts against at least one of said piston means and causes said piston to revolve.

5. The device of claim 4 wherein said means for introducing said fuel/air mixture into said cylinder at predetermined times comprises a device for compressing said fuel/air mixture.

6. An internal combustion engine having a substantially constant torque and piston means which revolves past cooperating piston means comprising:

wall means defining at least one toroidal cylinder, at least one pair of discs mounted for revolving with respect to said cylinder and with respect to each other, a drive shaft mechanism carrying said discs such that said discs revolve with respect to said cylinder, piston means cooperating to define an expanding chamber during revolution of said discs, said piston means including at least one cooperating pair of pistons, each of said pistons being mounted on a respective disc which revolves within said cylinder, means for controlling the mode of operation of said piston means such that said pistons are selectively placed in a passing mode and an expansion mode at predetermined times during the revolution of said piston means, said piston means being positionable in a passing mode such that at least one of said piston means can revolve past its cooperating piston means during revolution of said discs, and said pistons being positionable in an expansion mode such that the opposite end portions of the chamber defined between cooperating pairs of piston means are defined by said cooperating piston means, each piston means including a piston head proportioned for sealing the cross-section of said cylinder upon being positioned in said expansion mode, and means for introducing a mixture of fuel and air inbetween said piston means at predetermined times.

7. The internal combustion engine of claim 6 including means for igniting said fuel air mixture such that a mixture of combusted gases expands within said cylinder and acts against said piston means.

8. The internal combustion engine of claim 6 including rotational control means for controlling the respective rotational position of each of said pistons.

9. The internal combustion engine of claim 8 wherein said means for introducing an expanding mixture of fuel and air inbetween said piston means at predetermined times includes means for compressing said fuel/air mixture prior to its being ignited, said compression means comprising:

wall means defining at least one toroidal cylinder, at least one pair of discs, mounted for revolving with respect to said cylinder and with respect to each other, a drive shaft mechanism carrying said discs such that said discs revolves with respect to said cylinder, piston means cooperating to define an expanding chamber during revolution of said discs, said piston means including at least one cooperating pair of pistons, each of said pistons being mounted on a respective disc which revolves within said cylinder, means for controlling the mode of operation of said piston means such that said pistons are selectively placed in a passing mode and an expansion mode at predetermined times during the revolution of at least one of said piston means, said piston means being positionable in a passing mode such that at least one of said piston means can revolve passed its cooperating piston means during revolution of said discs, and said pistons being positionable in an expansion mode such that the opposite end portions of the chamber defined between cooperating pairs of piston means are defined by said cooperating piston means, each piston means including a piston head proportioned for sealing the cross-section of said cylinder upon being positioned in said expansion mode, and means for introducing a mixture of fuel and air inbetween said piston means at predetermined times.

10. An internal combustion engine having a substantially constant torque and piston means which revolve past each other comprising:

wall means defining a toroidal cylinder, a pair of discs which revolve in opposite directions, a drive shaft mechanism carrying each of said discs, piston means mounted on each of said discs and revolving in a predetermined direction within said cylinder, said piston means being arranged in cooperating pairs in said cylinder, each piston means of each of said cooperating pairs revolving in a direction opposite to the direction of the revolution of its cooperating piston means, such that each of said cooperating pairs of piston means defines an expanding chamber, each of said piston means including a piston head rotatably mounted on said disc, said piston head being proportioned for sealing the cross-section of said cylinder upon being positioned in one predetermined rotational position, and said piston head being proportioned such that its cross-sectional area is less than the cross-sectional area of said cylinder upon said piston head being positioned in a further rotational position, means for controlling the rotational position of each of said piston heads, and means for introducing a mixture of fuel and air inbetween said piston heads at a predetermined time.

11. The internal combustion engine of claim 10 wherein said means for controlling the rotational position of each of said piston heads comprises a gear and cam arrangement.

12. The internal combustion engine of claim 11 including means for igniting said fuel and air mixture at predetermined times.

13. The internal combustion engine of claim 12 including means for controlling the relative revolutionary position of said discs and the piston means carried thereby.

14. An internal combustion engine comprising:

a compression bank and an expansion bank, each of said banks including wall means defining a toroidal cylinder, a pair of discs which rotate in opposite directions, a drive shaft mechanism carrying each of said discs such that the perimeter of each of said discs is proximate said cylinder, piston means mounted on each of said discs and including a piston head proportioned for sealing the cross-section of said cylinder upon being positioned in one rotational position, and being proportioned such that its cross-section area taken perpendicular to the direction of the piston head travel is less than the cross-sectional area of said cylinder upon said piston head being positioned in a further rotational position, said pistons being arranged in cooperating pairs in the cylinders of said compression bank and said expansion bank, said pistons of said expansion bank defining expanding chambers between said pistons in said expansion bank and said pistons of said compression bank defining contracting chambers in said cylinder between said pistons of said compression bank, and means for controlling the rotational position of each of said pistons in said compression bank and said expansion bank.

15. A device for compressing/expanding a fluid comprising:

wall means defining at least one toroidal cylinder, a drive shaft mechanism including first drive shaft means and further drive shaft means, first disc means carried by said further drive shaft means, further disc means carried by said further drive shaft means, first piston means rotatably mounted on said first disc means and including a first piston head disposed within said cylinder, said first piston head revolving within said cylinder in a predetermined direction responsive to said first disc revolving, further piston means rotatably mounted on said further disc means and including a further piston head disposed within said cylinder, said further piston head revolving within said cylinder in a predetermined direction responsive to said first disc revolving, means for rotating said first and further piston heads within said cylinder at predetermined times during the revolution of said piston means such that said piston means can pass during such revolution, and means for revolving the discs in opposite directions.

* * * * *